United States Patent [19]

Freeman et al.

[11] 4,295,073

[45] Oct. 13, 1981

[54] MICROCHANNEL PLATE-IN-WALL STRUCTURE

[75] Inventors: Charles F. Freeman, Springfield; Kurt Villhauer, Annandale, both of Va.

[73] Assignee: The United States of America as represented by the Secretary of the Army, Washington, D.C.

[21] Appl. No.: 890,899

[22] Filed: Mar. 28, 1978

[51] Int. Cl.[3] ..... H01J 43/22; H01J 43/28

[52] U.S. Cl. ..... 313/105 CM; 313/95

[58] Field of Search ..... 313/103 CM, 105 CM, 313/95; 250/213 VT

[56] References Cited

U.S. PATENT DOCUMENTS

| | | | |
|---|---|---|---|
| 2,813,213 | 11/1957 | Cramer et al. | 313/429 |
| 3,284,655 | 11/1966 | Oess | 313/286 |
| 3,489,966 | 1/1970 | Bradu et al. | 313/283 X |
| 3,567,947 | 3/1971 | Robbins | 250/213 VT |
| 3,675,028 | 7/1972 | Grant | 313/105 CM X |
| 3,708,673 | 1/1973 | Blacker | 313/95 X |
| 3,875,452 | 4/1975 | Krause | 313/482 |
| 3,911,167 | 10/1975 | Linder | 313/105 CM X |
| 4,020,376 | 4/1977 | Bosserman et al. | 313/103 CM |
| 4,024,390 | 5/1977 | Bosserman et al. | 250/213 VT |
| 4,031,552 | 6/1977 | Bosserman et al. | 313/105 CM X |

*Primary Examiner*—Robert Segal

*Attorney, Agent, or Firm*—Nathan Edelberg; Milton W. Lee; John E. Holford

[57] ABSTRACT

The invention relates to a microchannel plate-in-wall structure wherein a rim portion of a microchannel plate extends through and is permanently sealed to a hollow generally cylindrical glass walled structure which is easily processed into an image intensifier tube, the external terminals of the plate being part of the electrodes deposited thereon.

9 Claims, 2 Drawing Figures

MICROCHANNEL PLATE-IN-WALL STRUCTURE

The invention described herein may be manufactured, used and licensed by the U.S. Government for governmental purposes without the payment of any royalties thereon.

BACKGROUND OF THE INVENTION

The use of microchannel plates has greatly improved image intensifier tubes. These plates consist essentially of a large number of uniform electron multiplier channels the input and output apertures of which match the minimum resolution of the image intensifier. In addition to being more compact than other types of electron optics, these plates are inherently self limiting to prevent blooming and related effects. Although the image intensifier tube walls may both be made of vitreous or ceramic material, the requirement for electrical connections has resulted in complicated structures with multiple metal contacts sealed through the tube walls. Not only are these structures costly, but they are prone to failure through loss of vacuum.

SUMMARY OF THE INVENTION

An object of the present invention is to provide an integrated microchannel plate and wall structure which greatly simplifies intensifier tube construction and provides a longer life tube.

BRIEF DESCRIPTION OF DRAWINGS

The invention is best understood with reference to the accompanying drawings wherein.

DESCRIPTION OF PREFERRED EMBODIMENT

Figure 1:
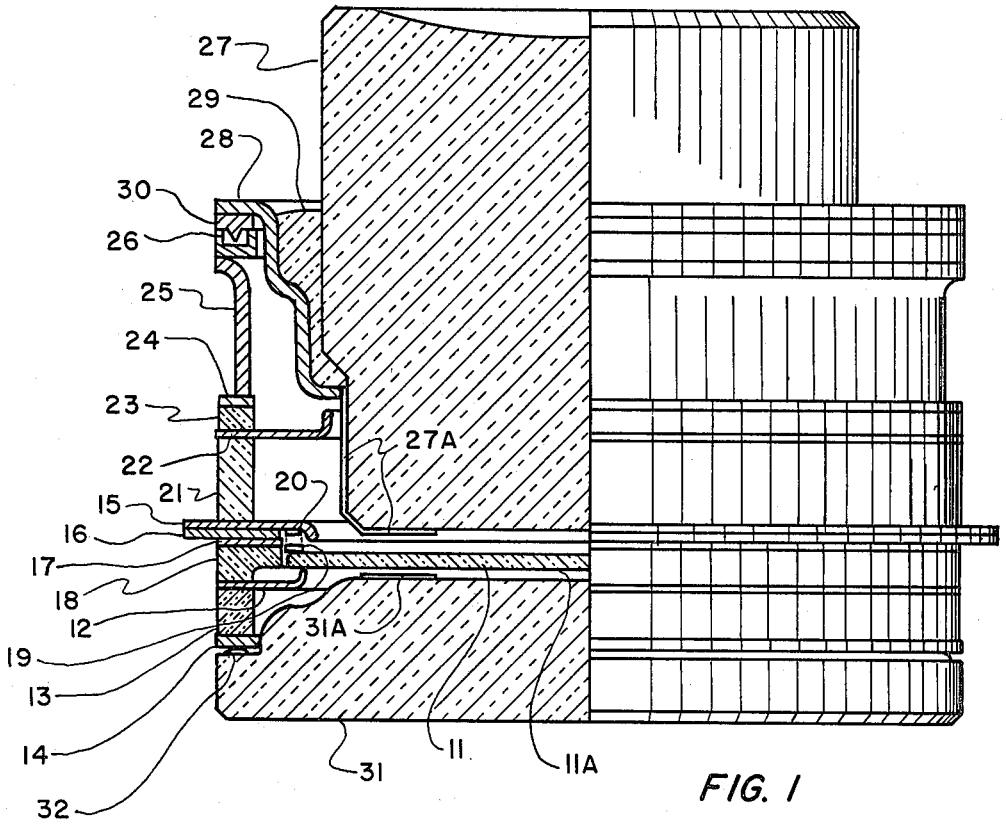
FIG. 1 shows a typical intensifier tube from the prior art.

Referring more specifically to FIG. 1 the prior art intensifier tube incorporates a standard microchannel plate 11. The plate itself is perforated to provide a semiconducting glass structure having numerous electron multiplier channels extending through its thickness dimension. The opposite broad surfaces of the plate are plated with conductive material (not shown) to provide two spaced electrodes between which is applied the accelerating voltage for the channels. The more negative plate terminal 12 of the tube consists of an annular conductor contacting one electrode and supporting said plate from one side. One end of a cylindrical metallized ceramic wall portion 13 is sealed to this terminal and a cathode terminal 14 is sealed to the opposite end thereof. The remaining electrode of the plate contacts a three piece terminal consisting of elements 15–17 brazed together and sealed to a second vitreous metallized wall portion 18, which in turn is sealed to plate terminal 12. Contact and support are completed by a flat metal washer 19 and a wavy washer 20, the latter being compressed to provide a spring contact. The wall structure continues with a third vitreous metallized wall section 21 sealed to terminal element 15 at one end and to a getter shield terminal 22 at the other. This is followed by a fourth vitreous metallized wall section 23 sealed to terminal 22 and an anode terminal including metal elements 24–26. Element 30 has a vacuum sealing knife edge which penetrates an indium ring during final assembly. All of the wall elements are toroidal and are preassembled before evacuating the tube. A fiber optic face plate 27 composed of spiralled glass fiber seals the anode end of the tube and serves as an image inverter. A conventional electroded phosphor screen structure **27*a* covers the inner surface of this face plate and its electrode contacts terminal element 28 which is also sealed to the face plate by a vitreous seal 29. A getter (not shown) is connected between an anode element and shield 22, the latter protecting the phosphor screen and microchannel plate when the getter is vaporized. A cathode face plate, coated on its inner surface with a photocathode structure 31*a*, seals the remaining open end of the tube. The cathode electrically contacts terminal element 14 and the seal is formed by a ring 32 of indium compressed between terminal 14 and faceplate 31. Intensifier tubes which are designed for extended service life incorporate a thin membrane 11*a*** generally referred to as an ion barrier film. This membrane is in contact with the surface of the plate nearer to the cathode, extends to the solid border of the MCP, and physically closes off each channel. In operation, the membrane is transparent to photoelectrons from the photocathode, but acts as a barrier to prevent ions and gases evolved during electron multiplication from reaching the sensitive photocathode surface.

The performance, reliability, and cost of the image intensifier are directly related to the design and construction of the tube walls. The imaging quality of the tube is critically affected by the spacing between the faceplate and the microchannel plate. Therefore, it is necessary to maintain close tolerance on every element of the tube wall. In extended life tubes, the design of the plate supporting terminals affects the efficiency with which the photocathode is protected from contaminants. A supporting terminal with high molecular conductance and ion leakage counteracts one of the functions of the ion barrier film, i.e. isolation of the photocathode and screen cavities. The cost and reliability are related to the number of parts and, hence, the number of seals necessary to form the tube walls. Each seal has the potential of degrading the tube vacuum either by an actual leak or by an occluded impurity. The numerous parts shown in FIG. 1 require considerable manufacturing to produce as well as extensive handling to assemble. Both the numbers of the parts and their assembly enhance the possibility of tube failure due to construction error, damage, and contamination. The convoluted interior surface of the resulting structure has a high surface area, which is a design deficiency for vacuum envelops. Finally, the reliability of the assembly is diminished by the use of springs inside the vacuum envelop for electrical contacts and mechanical support.

Figure 2:
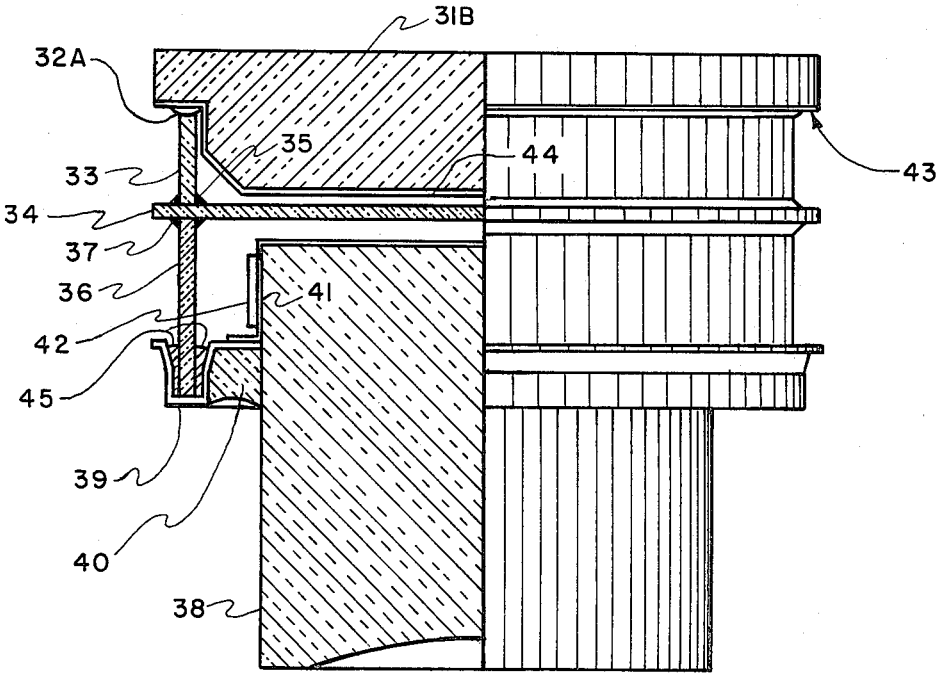
FIG. 2 shows an image intensifier tube using applicants microchannel plate-in-the-wall (MIW) assembly.

FIG. 2 shows an image intensifier tube according to the present invention. The tube uses essentially the same input cathode faceplate **31*b* as shown in FIG. 1 (element 31) which is sealed to the wall structure by an indium ring 32*a* equivalent to that also shown in FIG. 1 (element 32). The wall structure and its relation to the microchannel plate (MCP), however, are completely different. A first hollow cylindrical wall section 33, with its axis normal to the MCP and a cross-section smaller than that of the broad surfaces thereon, is sealed to the border of one of the broad surfaces. The joint is formed by melting a glass frit 35 applied to the mating edge of wall section. The frit may be a vitreous type, but a devitrifying type is preferred. The frit is applied with a suitable binder which vaporizes as the frit melts. The frit which may be, for example, Code 7575 Sealing Glass made by the Corning Glass Company, is preferably further heated until devitrication of the frit is accomplished. The sidewall is made of lead glass such as Kimble's G12, Corning's 8161 or Corning "MACOR", for example, which is reduced by heating in hydrogen to produce semiconductivity on the wall section. This provides adequate electrical isolation between the metal terminals at either end of the wall section, but is sufficiently conductive to avert buildup of electrical charge thereon when the tube is in operation. Since the indium ring 32***a* wets the glass wall surface better than any other substance no intermediate grading elements are necessary. The frit mentioned above also makes an excellent bond with the electroded surface of the MCP. The electrode is typically Inconel. Although not generally necessary, the Inconel can be protected (or a less durable electrode employed) if the plate is coated with a few angstroms of $SiO_x$ (where x ranges from 1-2, preferably nearly 1). Such a layer produces no noticeable change in performance of the MCP. A second wall section 36 similar to the first is sealed to the opposite broad surface of the MCP to form an MCP-in-wall structure (MIW). Both walls can be sealed simultaneously, preferably with pressure applied to the sandwich-like structure during sealing. The image inverting faceplate 38 with its anode terminal 39 attached by a conventional glass to metal seal 40 completes the structure. Just before the faceplates are attached to the MIW, in an evacuated vacuum chamber, getter material 41 is vaporized onto the cylindrical outer surface of the anode faceplate, the vapor being confined by a shielding structure mounted in the evacuated chamber. This faceplate with phosphor screen and getter is then sealed within the tube by placing the MIW structure in the anode terminal's trough like structure and heating the indium 45 therein to its melting point. The cathode plate is then sealed to the MIW and by pressing the substrate against the MIW cold flowing the indium ring 32*a*. The electrode layer 43, which is part of a conventional phosphor cathode ray viewing screen, is attached within the tube to terminal 39. The cathode which is merely the conductive layer of a photocathode extends to the outer edges of the cathode faceplate under the indium seal. Both of the electrode layers can be contacted from the outside of the tube. The electrodes of the MCP are similarly coatings which cover the full diameter of the MCP and pass through the frit seals 35 and 37. If an ion barrier film membrane is used with this structure, a near perfect physical barrier is established between the two distinct regions of the tube: that region devoted to photoemission and electro-optical focussing of the photoelectrons, and that devoted to electron multiplication and electro-optical display. Thus, protection of the chemically sensitive photocathode is maximized and is limited only by the perfection of the membrane.

Not only does the above structure of the MIW eliminate much of the structure of prior art tubes, but it makes possible a single assembly procedure for a family of sophisticated viewing tubes. Since the electrodes of the MCP are deposited, it is a simple matter to provide a variety of masks which divide these electrodes into a number of smaller independent electrodes. As an example, the channels may be separated into a number of rows by strip electrodes on one side and a number of columns, perpendicular to the rows, on the other side. The channels could then be addressed with conventional x-y voltage pulses for computer processing. Prior art tubes would require a very complex arrangement of terminals sealed through the walls, and the probability of perfect contact at every terminal would be very low. In applicants device, however, it is only necessary to carry the electrode patterns to the external edges of the MCP and the contacts will extend outside of the finished tube, where they can be individually contacted or even soldered and unsoldered.

Many variations of the above described structure will be immediately obvious to those skilled in the art, but the invention is limited only as defined in the claims which follow.

I claim:

1. A microchannel plate-in-wall structure comprising:

a microchannel plate consisting of semiconducting glass, having anode and cathode surfaces and a plurality of electron multiplier channels therebetween;

at least one continuous thin planar electrode deposited on each of said surfaces, said electrode extending substantially to the edge of said plate as well as adjacent to and surrounding one end of at least one of said channels; and a first hollow generally cylindrical glass wall section axially positioned normal to one of said surfaces and sealed with glass directly to said electrode and plate, said wall section at said surface having a minimum cross-section which encloses all of the ends of said channels at said one surface, and a maximum cross-section smaller than said one surface, whereby said one plate surface and each said one thin planar electrode it supports is divided into a pair of exposed portions which lie on opposite sides of said wall interconnected by a third portion sealed between said wall and said plate.

2. A microchannel plate-in-wall structure according to claim 1 wherein said wall comprises:

a lead oxide glass reduced by heating in a hydrogen atmosphere.

3. A microchannel plate-in-wall structure according to claim 1 wherein:

said wall is sealed to said one surface with a glass frit which has been melted and devitrified.

4. A microchannel plate-in-wall structure according to claim 3 wherein:

said frit is Corning Sealing Glass Code 7575.

5. A microchannel plate-in-wall structure according to claim 1 wherein:

said anode and cathode surfaces each support a plurality of strip electrodes, each electrode on one broad surface surrounding the ends of channels which lie in one of a plurality of rows and each electrode on the remaining broad surfaces surrounding the ends of channels which lie in one of a plurality of columns substantially perpendicular to said rows.

6. A microchannel plate-in-wall structure according to claim 1 wherein:

said microchannel plate is coated with a layer of $SiO_x$ having a thickness of 200 angstroms at least over the area where said wall intersects said one surface.

7. A microchannel plate-in-wall structure according to claim 6 wherein:

the value of "x" is substantially unity.

8. A microchannel plate-in-wall structure according to claim 1 wherein:

a second hollow wall section is sealed to the opposite broad surface of said microchannel plate in the same relationship thereto as said first wall section.

9. A microchannel plate-in-wall structure according to claim 5 wherein:

a second hollow wall section is sealed to the opposite broad surface of said microchannel plate in the same relationship thereto as said first wall section.

* * * * *